US006357487B2

(12) United States Patent
Okawa

(10) Patent No.: US 6,357,487 B2
(45) Date of Patent: Mar. 19, 2002

(54) SURFACE FASTENER WITH DOUBLE WEAVING STRUCTURE

(75) Inventor: Mitsuhisa Okawa, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/841,244

(22) Filed: Apr. 25, 2001

(30) Foreign Application Priority Data

Apr. 28, 2000 (JP) ..... 2000-130652

(51) Int. Cl.[7] ..... D03D 15/00
(52) U.S. Cl. ..... 139/410; 139/392
(58) Field of Search ..... 139/410, 392

(56) References Cited

U.S. PATENT DOCUMENTS 4,467,839 A * 8/1984 Westhead ..... 139/383 A
5,783,278 A * 7/1998 Nishimura et al. ..... 428/102
5,888,915 A * 3/1999 Denton et al. ..... 442/200
5,904,187 A * 5/1999 Davenport ..... 139/383 AA

* cited by examiner

*Primary Examiner*—Andy Falik
(74) *Attorney, Agent, or Firm*—Finnegan, Henderson, Farabow, Garrett & Dunner, L.L.P.

(57) ABSTRACT

A woven double cloth surface fastener structure comprising front and rear woven foundation fabrics. An engaging element yarn protrudes from at least one of the fabrics, and a thermal melting yarn is woven between the fabrics, the thermal melting yarn has a melting point less than the melting point of the engaging element yarn and has a melting point less than the melting point of warp and weft yarns defining the woven double cloth surface fastener structure. The thermal melting yarn is configured to weld the front and the rear fabrics together when heated.

8 Claims, 8 Drawing Sheets

SURFACE FASTENER WITH DOUBLE WEAVING STRUCTURE

BACKGROUND OF THE INVENTION

1. Field of the Invention

The present invention relates to a surface fastener having a stabilized configuration formed of foundation cloth the rear face of which is not required to be back-coated with thermoplastic resin.

2. Description of the Related Art

Conventionally, a so-called back-coating method has been well known to fasten an engaging element yarn to a foundation cloth by coating an entire rear face of the foundation cloth with resin such as polyester base resin, polyurethane base resin and the like. Consequently, the engaging element yarn woven into the foundation cloth woven of warp yarn and weft yarn is fastened to the foundation cloth firmly, so that a tough surface fastener is produced. This method has been disclosed in, for example, Japanese Patent Application Laid-Open No. 11-244010.

Japanese Patent Application Laid-Open No. 7-289312 has disclosed another method. According to this method, as shown in FIG. 11, the foundation cloth of the surface fastener is woven with a double weaving structure and then, resin such as polyester base resin, polyamide base resin, polyacrylic base resin and polyurethane base resin is soaked between front foundation cloth 4' and rear foundation cloth 5'. Alternatively, melted resin is applied for coating the rear foundation cloth 5' of the double cloths, and by putting a pressure with an appropriate means, the melted resin is soaked into the front foundation cloth 4' to form a thick foundation cloth by hardening it with heat.

Because resin such as polyester base resin and polyurethane base resin is applied to an entire rear face of the woven foundation cloth, the rear face of the foundation cloth of the surface fastener is stiffened, so that the aforementioned surface fastener, which is back-coated, provides a poor textual feeling.

Further, in a surface fastener shown in FIG. 11, melted resin fluid is soaked from the rear foundation cloth 5' of the double-weaving structure composed of the front foundation cloth 4' and the rear foundation cloth 5' and a pressure is putted, so that the resin fluid is soaked into the front foundation cloth 4'. In this case, although the rear foundation cloth 5' is woven with a rough weaving density, it is difficult to make the resin fluid permeate sufficiently up to the front foundation cloth 4' and therefore, it is difficult to finish an excellent quality surface fastener in which the front foundation cloth 4' and the rear foundation cloth 5' are integrated firmly. Further, because an additional process step for making the melted resin fluid permeate and hardening it by heat is necessary, it takes a long time for production and an additional troublesome process must be carried out.

SUMMARY OF THE INVENTION

The present invention has been achieved in views of the above described problems. An object of the invention is to provide a surface fastener made of double cloths in which front foundation cloth and rear foundation cloth are integrated firmly through their opposing faces and a root or a trunk portion of a engaging element is fixed, thereby making it possible to produce an excellent quality surface fastener securing an excellent tactual feeling and having a double weaving structure with which can be produced more easily than the conventional product.

Another object of the invention is to provide a surface fastener which can be applied to various double cloths easily and produced easily with an excellent quality having a double weaving structure.

And another object of the invention is to provide a surface fastener in which a thermal melting yarn disposed in the double cloths can be held in a stabilized condition so that the front foundation cloth and the rear foundation cloth are welded together firmly and further, the front foundation cloth and the rear foundation cloth are fixed firmly with a binding yarn, thereby ensuring an excellent quality.

Also another object of the invention is to provide an excellent quality surface fastener in which the engaging element yarn is disposed on one or both of the front foundation cloth and the rear foundation cloth of the double cloths, and the engaging element is formed such that it is implanted so as to be protruded from the surface of the surface fastener and a root or a trunk portion of the engaging element is fixed firmly.

To achieve the above object, according to the main aspect of the invention, in double cloths composed of front foundation cloth and rear foundation cloth, an engaging element yarn for forming a loop-like or hook-like engaging element of a surface fastener is woven into the front foundation cloth or the rear foundation cloth, and the loop-like engaging element or the hook-like engaging element is implanted so as to be protruded from the surface of the woven face. Then, a thermal melting yarn having a lower melting point than warp yarn and weft yarn composing the foundation cloths and and the engaging element yarn is inserted and woven so as to intervene between the front foundation cloth and the rear foundation cloth and by melting the thermal melting yarn by heating, the front foundation cloth and the rear foundation cloth are welded together integrally through their inner faces and the engaging element is fixed firmly.

Preferably, the double cloths are formed with hollow cloths and the thermal melting yarn is disposed longitudinally so as to be inserted and intervene in the hollow cloths.

Alternatively, the double cloths are formed with stitched double cloths, in which the front foundation cloth and the rear foundation cloth are bound together, and the thermal melting yarn is disposed so as to be inserted and intervene between the front foundation cloth and the rear foundation cloth.

Preferably, the front foundation cloth and the rear foundation cloth of the double cloths are bound together by the binding yarn disposed longitudinally and the binding yarn is disposed so as to intervene between the engaging element yarns woven longitudinally in the front and rear foundation cloths.

Further preferably, the binding yarn for binding the front foundation cloth and the rear foundation cloth of the double cloths binds the front foundation cloth with the rear foundation cloth longitudinally at a predetermined interval.

Still further, the engaging element yarn for forming the engaging element is woven into the front foundation cloth of the double cloths such that the engaging element is implanted so as to be protruded from the surface thereof.

Alternatively, the engaging element yarn for forming the engaging element is woven into the rear foundation cloth of the double cloths such that the engaging element is implanted so as to be protruded from the surface of the front foundation cloth, but not the rear foundation cloth.

Alternatively, the engaging element yarn for forming the engaging element is woven into the front foundation cloth and the rear foundation cloth of the double cloths fabric such that the engaging elements are respectively implanted so as to be protruded outward from the surfaces of the front foundation cloth and the rear foundation cloth.

DESCRIPTION OF THE PREFERRED EMBODIMENTS

Figure 1:
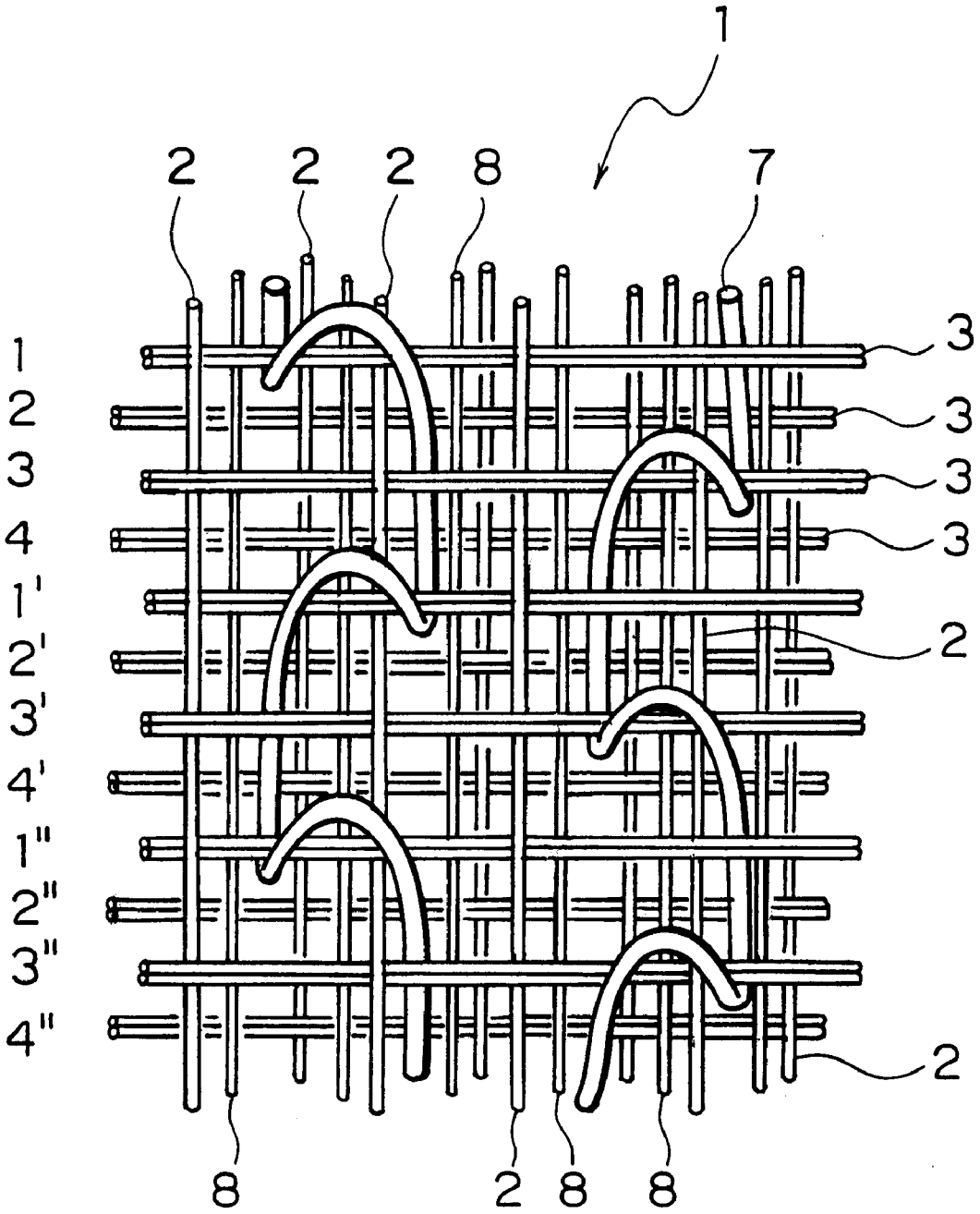
FIG. 1 is a plan view showing arrangement of yarns for weaving an engaging element yarn into front foundation cloth.

Hereinafter, the embodiments of the surface fastener of the present invention will be described in detail with reference to the accompanying drawings.

The surface fastener of the present invention is a fabric 1 having a double weaving structure as shown in the Figures and formed of front foundation cloth 4 and rear foundation cloth 5 each woven of warp yarn 2 and weft yarn 3. An engaging element yarn 7 for forming an engaging element 6 of this surface fastener is woven into one or both of the front foundation cloth 4 and the rear foundation cloth 5. Preferably, the double cloths 1 is woven with a needle loom.

The double cloths 1 may be formed with hollow cloths composed of the warp yarns 2 disposed individually in the front foundation cloth 4 and the rear foundation cloth 5 and the common weft yarn 3 inverted repeatedly at an end of each of the foundation cloths 4 and 5 or with stitched double cloths composed of the warp yarn 2 and weft yarn 3 disposed individually in the front foundation cloth 4 and the rear foundation cloth 5.

In the Figures, for convenience for easy understanding, the weft yarn and warp yarn are represented in a relatively narrow line and the weaving structure is represented roughly. However, actually each of the weft yarns and warp yarns is a predetermined thickness yarn and the weaving structure is formed finely considering the function as the surface fastener, so that a function of the surface fastener can be exerted properly.

Figure 2:
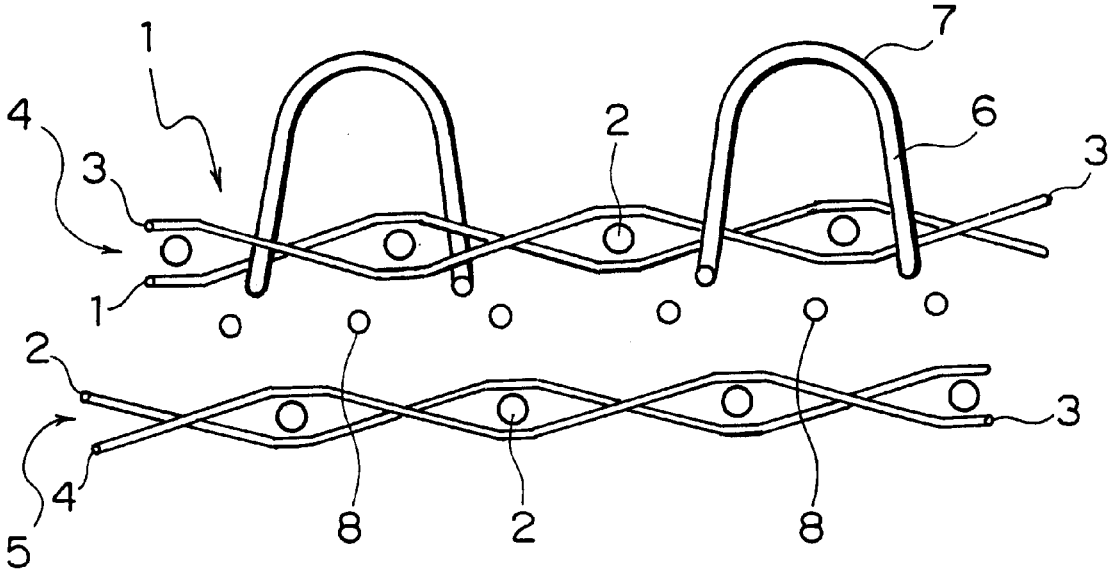
FIG. 2 is a schematic view showing a lateral section of the arrangement of the yarns of FIG. 1.

In the surface fastener shown in FIGS. 1 and 2, the front foundation cloth 4 and the rear foundation cloth 5 are woven of the warp yarn 2 made of polyamide base, polyester base or polypropylene base synthetic resin and the weft yarn 3 of double pick, made of the same synthetic resin. Engaging element yarn 7 for forming the engaging element 6 of the surface fastener is woven into the front foundation cloth 4. If a loop-like engaging element 6 is formed using this engaging element yarn 7, multi-filament of synthetic resin such as polyamide base, polyester base or polypropylene base is woven into the front foundation cloth 4 and after that, it is napped or brushed so as to form the loop-like engaging element 6. If it is intended to form a hook-like engaging element 6, mono-filament of said synthetic resin is woven into the front foundation cloth 4 and a side of the loop is cut out so as to form the hook-like engaging element 6.

As for a concrete weaving configuration, both the front foundation cloth 4 and the rear foundation cloth 5 are woven with the warp yarn 2 and the weft yarn 3 of double pick in a plain weaving structure and then, the engaging element yarn 6 is woven into this plain weaving structure. The engaging element yarn 7 is woven in the shape of a loop so as to stride laterally over a single warp yarn 2 every several picks so that the loop portion of the engaging element 6 is formed on the surface so as to protrude therefrom. Meanwhile, the foundation cloths 4 and 5 are not restricted to the plain weaving structure, but may be woven with other weaving structure.

The feature of the surface fastener of the present invention is that thermal melting yarn 8 of synthetic fiber having a lower melting point than the synthetic fiber of the warp yarn 2, the weft yarn 3 and the engaging element yarn 7 is inserted and woven so as to intervene between the front foundation cloth 4 and the rear foundation cloth 5 of the woven double cloths 1 as described above. Particularly, if the thermal melting yarn 8 is woven adjacent the engaging element yarn 7, it is advantageous for fixing the engaging element yarn 7 to the front foundation cloth 4 and the rear foundation cloth 5. For example, polyamide base nylon 66 fiber is used for the warp yarn 2 and weft yarn 3 composing the foundation cloths 4 and 5 and the engaging element yarn 7 and nylon 6 fiber is used for the thermal melting yarn 8. After weaving is completed, the thermal melting yarn 8 is melted by heating so that the front foundation cloth 4 and the rear foundation cloth 5 are welded integrally through their inner faces and part of the melted portion adheres to an inner face of a root of the engaging element 6, so that the root is fixed firmly to the front foundation cloth 4 and the rear foundation cloth 5. As the thermal melting yarn 8, it is permissible to use synthetic fiber of polyamide copolymer or polyester copolymer having a low melting point. When each of these thermal melting yarns 8 is melted so as to weld the front foundation cloth 4 and the rear foundation cloth 5, melted resin never permeates to the surface excessively, and consequently, a surface fastener having an excellent tactual feeling can be produced.

Although the thickness of the thermal melting yarn 8 may be selected arbitrarily, it is favorable to use a synthetic fiber thicker than the warp yarn 2 and weft yarn 3 composing the foundation cloths 4 and 5 and the engaging element yarn 7 from viewpoint of melting with heat.

Figure 3:
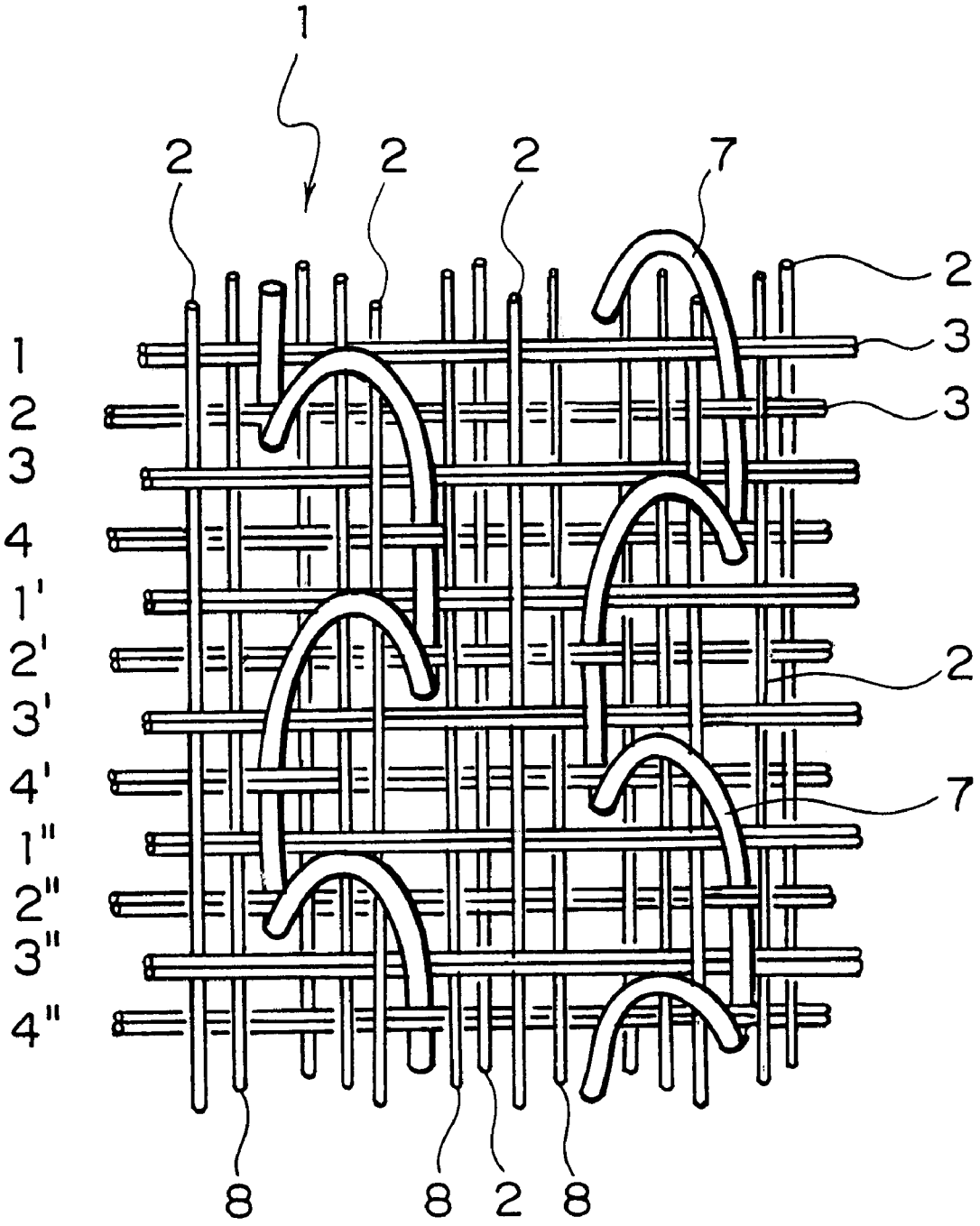
FIG. 3 is a schematic plan view showing arrangement of yarns for weaving an engaging element yarn into rear foundation cloth.
Figure 4:
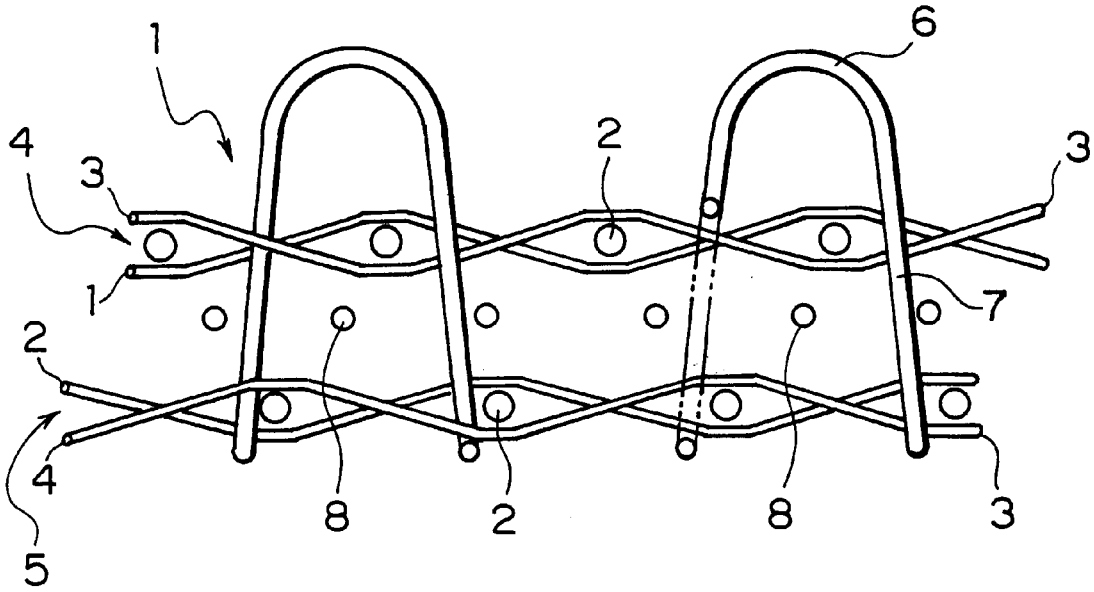
FIG. 4 is a schematic view showing a lateral section of the arrangement of the yarns of FIG. 3.

In the surface fastener shown in FIGS. 3 and 4, the front foundation cloth 4 and the rear foundation cloth 5 of the double cloths 1 are woven with a plain weaving structure using the warp yarn 2 of synthetic fiber made of polyamide base, polyester base or polypropylene base and the weft yarn 3 of double pick made of the same synthetic fiber like the above described example. Then, the engaging element yarn 7 for forming the loop-like engaging element 6 or the hook-like engaging element 6 is woven into the rear foundation cloth 5. The engaging element yarn 7 is made of the same synthetic fiber as the warp yarn 2 and the weft yarn 3. This engaging element yarn 7 strides over a warp yarn 2 of the rear foundation cloth 5 laterally and every several picks. At the same time, the engaging element 6 is formed in a condition that the loop portion thereof is protruded from the surface of the front foundation cloth 4.

In this surface fastener, the thermal melting yarn 8 of synthetic fiber having a lower melting point than the synthetic fiber of the warp yarn 2, the weft yarn 3 and the engaging element yarn 7 is inserted and woven so as to intervene between the front foundation cloth 4 and the rear foundation cloth 5 of the double cloths 1. For example, polyamide base nylon 66 fiber is used for the warp yarn 2, the weft yarn 3 and the engaging element yarn 7, and nylon 6 fiber is used for the thermal melting fiber 8. After weaving is completed, the thermal melting yarn 8 is melted by heating and then, the front foundation cloth 4 and the rear foundation cloth 5 are welded together integrally through their inner faces. Then, part of the melted portion adheres a root and a trunk portion of the engaging portion 6 and fix them firmly to the front foundation cloth 4 and the rear foundation cloth 5. As a result, a tough surface fastener having an excellent tactual feeling is produced.

Figure 5:
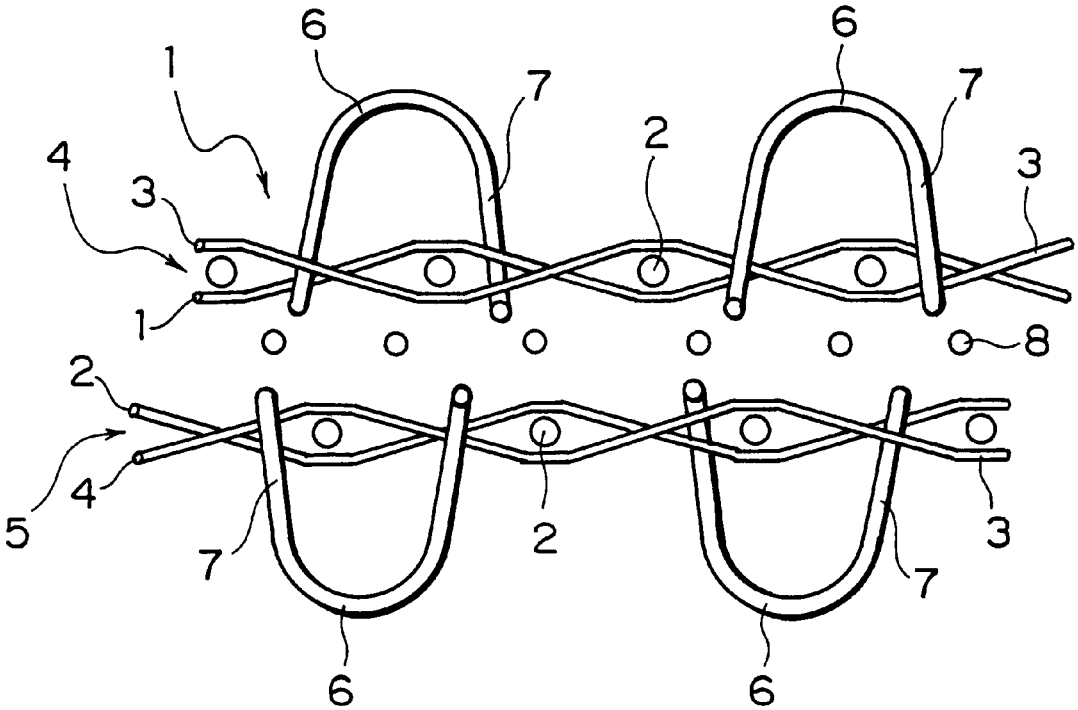
FIG. 5 is a schematic view showing a lateral section of the arrangement of yarns for weaving the engaging element yarn into the front foundation cloth and the rear foundation cloth.

In the surface fastener shown in FIG. 5, the front foundation cloth 4 and the rear foundation cloth 5 of the double cloths 1 are woven with the plain weaving structure using the warp yarn 2 of synthetic fiber made of polyamide base, polyester base or polypropylene base and the weft yarn 3 of double pick made of the same synthetic fiber like the above described examples. Then, the engaging element yarn 7 is woven into the front foundation cloth 4 and the rear foundation cloth 5 so as to form the loop-like engaging element 6 or the hook-like engaging element 6. The engaging element yarn 7 is made of the same synthetic fiber as the warp yarn 2 and the weft yarn 3. This engaging element yarn 7 strides over a warp yarn 2 of each of the front foundation cloth 4 and the rear foundation cloth 5 laterally and alternately every several picks. As a result, the engaging elements 6 are formed in a condition that the loop portions thereof are protruded from the both surfaces of the front foundation cloth 4 and the rear foundation cloth 5.

In this surface fastener, a synthetic fiber having a lower melting point than the synthetic fiber of each of the warp yarn 2 and the weft yarn 3 and the engaging element yarn 7 is used as the thermal melting yarn 8, and inserted and woven so as to intervene between the front foundation cloth 4 and the rear foundation cloth 5. After weaving is completed, the thermal melting yarn 8 is melted by heating so that the front foundation cloth 4 and the rear foundation cloth 5 are welded together integrally through their inner faces. Then, part of the molten portion adheres to a root of the engaging element 6 so that the roots are fixed firmly to the front foundation cloth and the rear foundation cloth. As a result, a tough surface fastener having such a solid structure is produced.

Meanwhile, when the engaging element yarns 7 are woven into the front foundation cloth 4 and the rear foundation cloth 5, the loop portion of the engaging element yarn 7 woven into the front foundation cloth 4 may be protruded from the surface of the rear foundation cloth 5 so as to form the engaging element 6 and the loop portion of the engaging element yarn 7 woven into the rear foundation cloth 5 may be protruded from the surface of the front foundation cloth 4 so as to form the engaging element 6. A melted portion of the thermal melting yarn 8 fastens the root and trunk portion of the engaging element 6 firmly, so that a tough surface fastener having the engaging elements 6 on both sides is produced.

Figure 6:
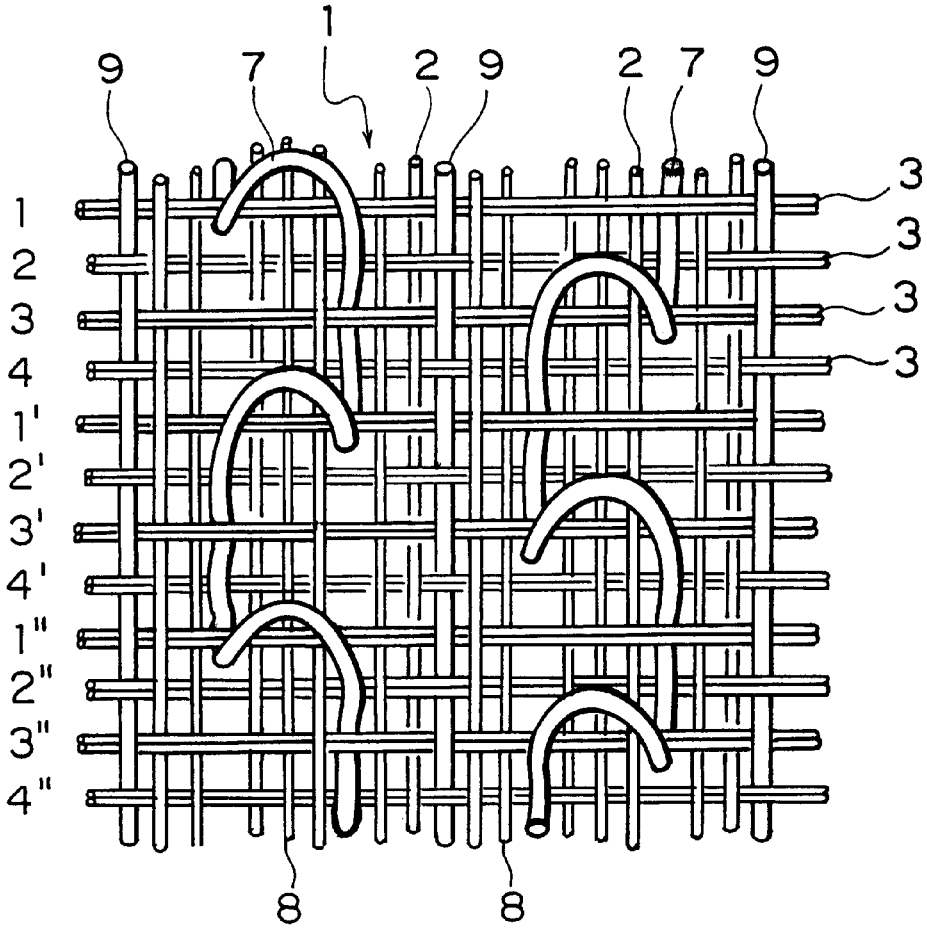
FIG. 6 is a schematic plan view showing arrangement of yarns for weaving the engaging element yarn into the front foundation cloth of bound double cloths.
Figure 7:
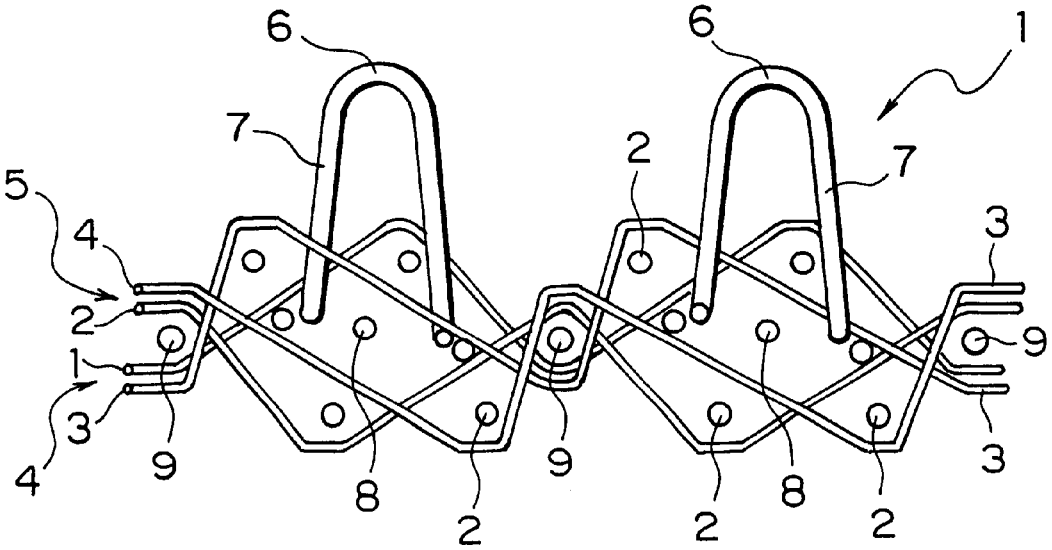
FIG. 7 is a schematic view showing a lateral section of the arrangement of the yarns of FIG. 6.

In the surface fastener shown in FIGS. 6 and 7, the front foundation cloth 4 and the rear foundation cloth 5 of the double cloths 1 are woven with the plain weaving structure using the warp yarn 2 and the weft yarn 3 of double pick of synthetic fiber of polyamide base, polyester base or polypropylene base. The engaging element yarn 7 for forming the loop-like engaging 6 or the hook-like engaging element 6 is made of the same synthetic fiber and woven into the front foundation cloth 4. As for the weaving structure of the engaging element yarn 7, like the above described embodiments, the engaging element yarn 7 is woven such that it strides over a warp yarn 2 of the front foundation cloth 4 laterally every several picks. The engaging element 6 is formed in a condition that it is protruded from the surface of the front foundation cloth 4, and at the same time, single binding yarn 9 made of the same synthetic fiber as described above is disposed such that it extends longitudinally, in the middle of the engaging element yarns 7 disposed longitudinally. The weft yarn 3 of double pick of the front foundation cloth 4 is bypassed below the binding yarn 9 and the weft yarn 3 of double pick of the rear foundation cloth 5 is bypassed above the binding yarn 9, so that the front foundation cloth 4 and the rear foundation cloth 5 are woven so as to be bound together.

Upon weaving, the thermal melting yarn 8 made of synthetic fiber having a lower melting point than the synthetic fiber of each of the warp yarn 2, the weft yarn 3 and the engaging element yarn 7 is inserted and woven so as to intervene between the front foundation cloth 4 and the rear foundation cloth 5 of the double cloths 1. For example, nylon 66 fiber is used for the warp yarn 2, the weft yarn 3 and the engaging element yarn 7, and nylon 6 fiber is used for the thermal melting yarn 8. Then, the thermal melting yarn 8 is inserted and woven so as to intervene longitudinally. After weaving is completed, the thermal melting yarn 8 is melted by heating, so that the front foundation cloth 4 and the rear foundation cloth 5 are welded together integrally through their inner faces. Then, part of the melted portion adheres to the root of the engaging element 6, so that the engaging element 6 is fixed to the front foundation cloth 4 and the rear foundation cloth 5 firmly. In this surface fastener having such a configuration, the binding yarn 9 woven into the double cloths 1 holds the thermal melting yarn 8 securely so as to prevent it from being deviated to the right or left. As a result, the front foundation cloth 4 and the rear foundation cloth 5 are welded together in a stabilized condition, so that a tough surface fastener is produced.

Figure 8:
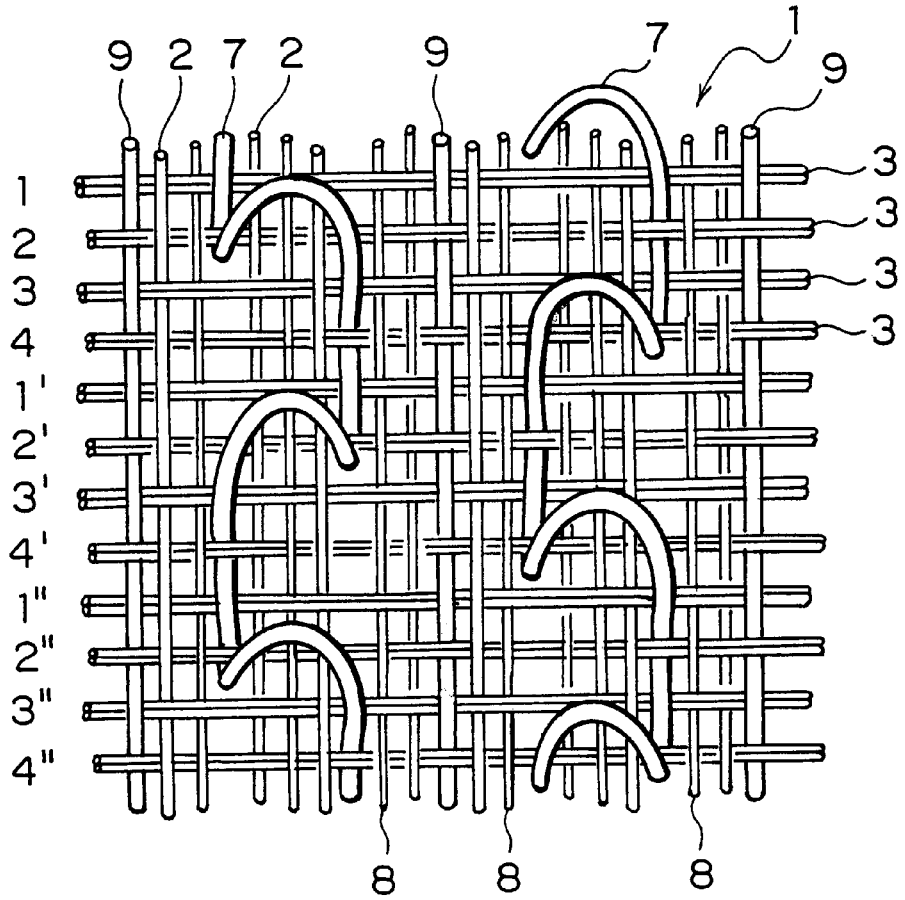
FIG. 8 is a schematic plan view showing arrangement of yarns for weaving the engaging element yarn into the rear foundation cloth of the bound double cloths.
Figure 9:
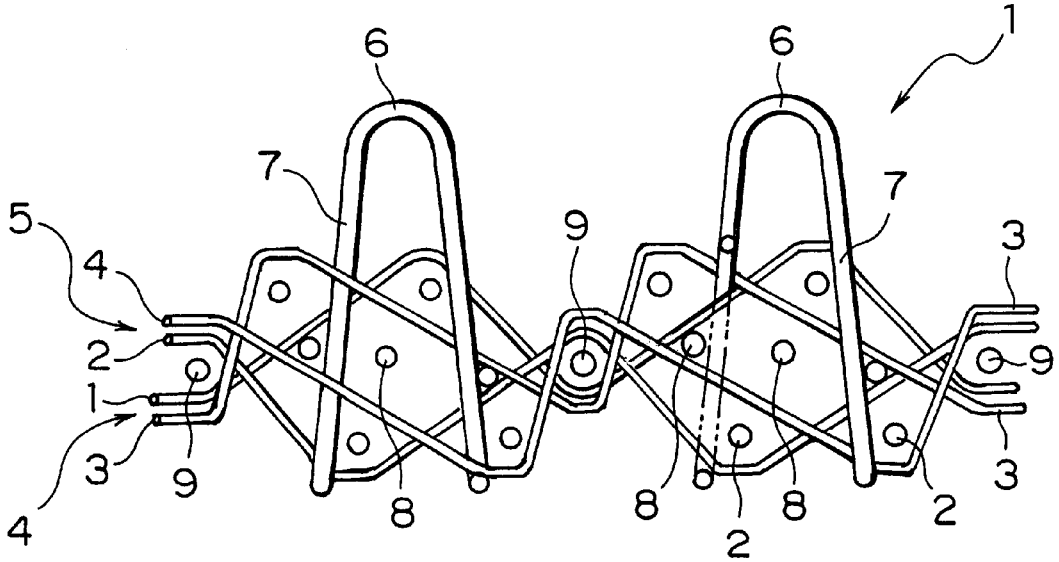
FIG. 9 is a schematic view showing a lateral section of the arrangement of the yarns of FIG. 8.

In the surface fastener shown in FIGS. 8 and 9, like the above described embodiments, the front foundation cloth 4 and the rear foundation cloth 5 of the double cloths 1 are woven with the plain weaving structure using the warp yarn 2 made of polyamide base, polyester base or polypropylene base synthetic fiber and the weft yarn 3 of double pick made of the same synthetic fiber. Then, the same synthetic fiber is used for the engaging element yarn 7 for forming the loop-like engaging element 6 or loop-like engaging element 6 and the engaging element yarn 7 is woven into the rear foundation cloth 5.

The engaging element yarn 7 is woven such that it strides over a single warp yarn 2 of the rear foundation cloth 5 laterally and alternately every several picks, and the engaging element 6 is formed in a condition that the loop portion thereof is protruded from the surface of the front foundation cloth 4. At the same time, the binding yarn 9 of synthetic fiber is disposed in the middle of the engaging element yarns 7 such that it is extended longitudinally. The weft yarn 3 of double pick of the front foundation cloth 4 is bypassed below the binding yarn 9 and the weft yarn 3 of double pick of the rear foundation cloth 5 is bypassed above the binding yarn 9, so that the front foundation cloth 4 and the rear foundation cloth 5 are woven so as to be bound together.

Upon weaving, the thermal melting yarn 8 of synthetic fiber having a lower melting point than the synthetic fiber of the warp yarn 2, the weft yarn 3 and the engaging element yarn 7 is inserted and woven so as to intervene longitudinally between the front foundation cloth 4 and the rear foundation cloth 5 of the double cloths 1. For example, nylon 66 fiber is used for the warp yarn 2, weft yarn 3 and engaging element yarn 7 and nylon 6 fiber is used for the thermal melting yarn 8. After weaving is completed, the thermal melting yarn 8 is melted by heating so that the front foundation cloth 4 and the rear foundation cloth 5 are welded together integrally through their inner faces.

In the surface fastener of this embodiment also, the thermal melting yarn 8 is held securely by the binding yarn 9. As a result, the thermal melting yarn 8 is never deviated to the right or left and a stabilized welding of the double cloths 1 is obtained. A melted portion of the thermal melting yarn 8 adheres to the root or trunk portion of the engaging element 6, so that the engaging element 6 is fixed to the front foundation cloth 4 and the rear foundation cloth 5 firmly. Consequently, a tough surface fastener having an excellent tactual feeling is produced.

Figure 10:
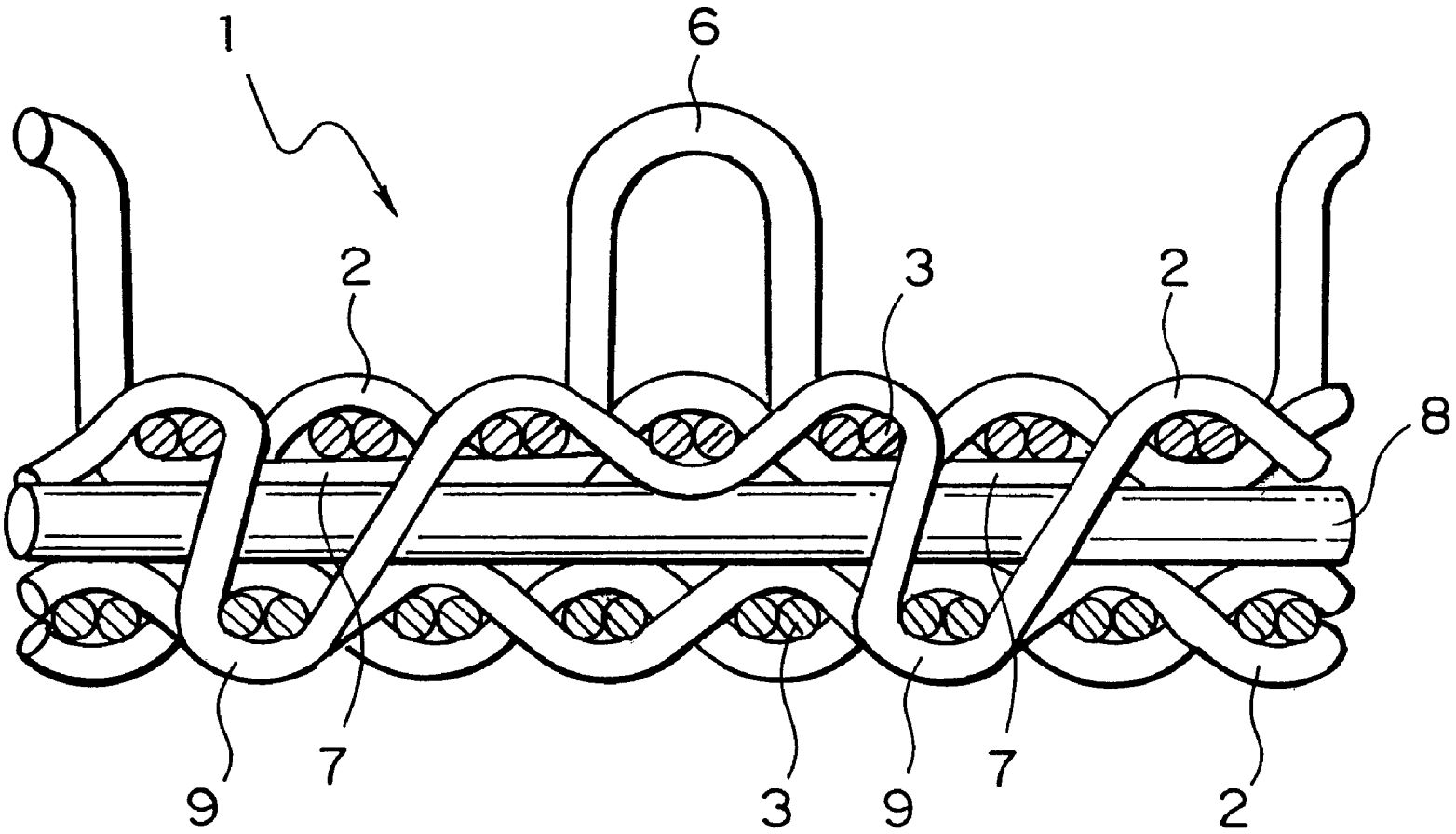
FIG. 10 is a longitudinal sectional view showing a condition in which the front foundation cloth and the rear foundation cloth are bound with binding yarn.
Figure 11:
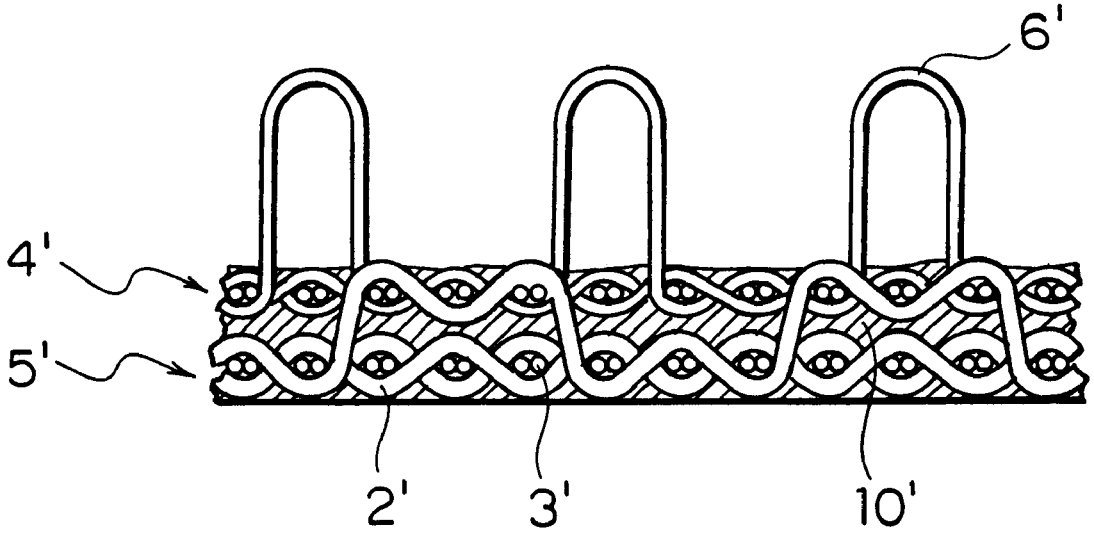
FIG. 11 (PRIOR ART)
FIG. 11 is a longitudinal sectional view of a well known surface fastener.

Finally, the surface fastener shown in FIG. 10 is a modification of the embodiment in which the front foundation cloth 4 and the rear foundation cloth 5 of the double cloths 1 are bound together. The front foundation cloth 4 and the rear foundation cloth 5 of the double cloths 1 are woven using the warp yarn 2 made of synthetic fiber of polyamide base, polyester base or polypropylene base and the weft yarn 3 of double pick made of the same material. The engaging element yarn 7 formed of synthetic fiber is woven into the front foundation cloth 4 and the engaging element yarn 7 is woven in the form of a loop such that it strides over a warp yarn 2 laterally and alternately every several picks. As a result, the engaging element 6 is formed so that the loop portion thereof is protruded from the surface of the front foundation cloth 4.

The thermal melting yarn 8 of synthetic fiber having a lower melting point than the synthetic fiber of each of the warp yarn 2, the weft yarn 3 and the engaging element yarn 7 is inserted and woven so as to intervene between the front foundation cloth 4 and the rear foundation cloth 5 of the double cloths 1 longitudinally. At the same time, the binding yarn 9 is disposed in the middle of the engaging element yarns 7 woven longitudinally, the binding yarn 9 intersects with and binds the weft yarn 3 of double pick of the rear foundation cloth 5. As a result, several thermal melting yarns 8 inserted and disposed between the front foundation cloth 4 and the rear foundation cloth 5 are prevented from being deviated laterally, so that the thermal melting yarns 8 are melted in a stabilized condition. And the root of the engaging element 6 is welded to the front foundation cloth 4 and the rear foundation cloth 5 firmly, so that a tough surface fastener is produced.

Meanwhile in the double cloths 1 of a type in which the front foundation cloth 4 and the rear foundation cloth 5 are bound with the binding yarn 9, the engaging elements 6 may be provided on both the front foundation cloth 4 and the rear foundation cloth 5.

A surface fastener of the invention has the above described structure, and exerts the following effects.

According to the invention, there is provided a surface fastener, wherein an engaging element yarn 7 for forming an engaging element 6 of the surface fastener is woven into front foundation cloth 4 and rear foundation cloth 5 of double cloths 1 such that the engaging element 6 is implanted so as to be protruded from the surface of a woven face and a thermal melting yarn 8 having a melting point lower than the warp yarn 2, the weft yarn 3 and the engaging element yarn 7 is woven between the front foundation cloth 4 and the rear foundation cloth 5 and melted by heating, so that the front foundation cloth 4 and the rear foundation cloth 5 are welded together integrally. Consequently, both the front foundation cloth 4 and the rear foundation cloth 5 are welded together firmly by the thermal melting yarn 8, and at the same time, part of the melted portion adheres to a root or trunk portion of the engaging element 6 so that the engaging element 6 is fixed to the foundation cloth firmly. Because the surface of the foundation cloth is not coated with resin, an excellent quality surface fastener having an excellent tactual feeling can be produced. Further, thick thick surface fastener can be produced with very simple means.

And the double cloths 1 are formed with hollow cloths and the thermal melting yarn 8 is disposed longitudinally in the hollow cloths. Consequently, because the foundation cloth has such hollow cloths, this surface fastener is suitable for a small-width surface fastener or single-body surface fastener.

And further, the double cloths 1 are formed with stitched double cloths and the thermal melting yarn 8 is disposed between the front foundation cloth 4 and the rear foundation cloth 5. Consequently, because the foundation cloth has the stitched double cloths, it is possible to produce a wide surface fastener having an arbitrary size easily.

Further, the front foundation cloth 4 and the rear foundation cloth 5 of the double cloths 1 are bound together by the binding yarn 9 disposed longitudinally, the binding yarn 9 is disposed between the engaging element yarns 7 woven longitudinally or the binding yarn 9 binds a foundation cloth with the other foundation cloth at a predetermined interval. Consequently, the thermal melting yarns 8 are prevented from being deviated laterally by the binding yarn 9 disposed between the engaging element yarns 7 woven longitudinally in the foundation cloth, so that the foundation cloths 4, 5 are welded together in a stabilized condition. As a result, an excellent quality surface fastener is produced.

Still further, the engaging element yarn 7 is woven into the front foundation cloth 4 of the double cloths 1 such that the engaging element 6 is implanted so as to be protruded from the surface thereof. Consequently, it is possible to produce a surface fastener easily, in which the engaging element 6 is implanted into the surface of the front foundation cloth 4 of the double cloths 1.

Still further, the engaging element yarn 7 is woven into the rear foundation cloth 5 of the double cloths 1 such that the engaging element 6 is implanted so as to be protruded from the surface of the front foundation cloth 4. Consequently, the root and trunk portion of the engaging element 6 are fixed in a stabilized condition, so that a tough surface fastener is produced.

Further, the engaging element yarn 7 is woven into the front foundation cloth 4 and the rear foundation cloth 5 of the double cloths 1 such that the engaging elements 6 are respectively implanted so as to be protruded outward from the surfaces of the front foundation cloth 4 and the rear foundation cloth 5. Because of it, a very convenient surface fastener can be produced easily. Further, the engaging elements can be fixed in a stabilized condition, so that a tough surface fastener is produced. As described above, the effects which the invention exerts are very conspicuous.

What is claimed is:

1. A surface fastener with double weaving structure comprising:

front and rear woven foundation fabrics;

an engaging element yarn protruding from at least one of the fabrics; and a thermal melting yarn woven between the fabrics, the thermal melting yarn having a melting point less than the melting point of the engaging element yarn and having a melting point less than the melting point of warp and weft yarns constituting the front and rear woven fabrics, the thermal melting yarn configured to weld the front and the rear fabrics together when heated.

2. The surface fastener with double weaving structure of claim 1, wherein the double weaving structure is formed with a hollow weaving structure and the thermal melting yarn is disposed longitudinally in said hollow weaving structure.

3. The surface fastener with double weaving structure of claim 1, wherein the double weaving structure is formed with a bound warp and weft weaving structure and the thermal melting yarn is disposed between the front fabric and the rear fabrics.

4. The surface fastener with double weaving structure of claim 1, further comprising a binding yarn disposed longitudinally in substantially the same longitudinal direction as the engaging element yarn, wherein the front fabric and the rear fabric are bound together by the binding yarn.

5. The surface fastener with double weaving structure of claim 4, wherein the binding yarn binds the front fabric with the rear fabric longitudinally at a predetermined interval.

6. The surface fastener with double weaving structure of claim 1, wherein the engaging element yarn is woven into the front fabric of the double weaving structure such that the engaging element is implanted so as to protrude from the surface thereof.

7. The surface fastener with double weaving structure of claim 1, wherein the engaging element yarn is woven into the rear fabric of the double weaving structure such that the engaging element is implanted so as to protrude from the surface of the front foundation cloth.

8. The surface fastener with double weaving structure of claim 1, wherein the engaging element yarn is woven into the front fabric and the rear fabric wherein the engaging yarn protrudes from both of the fabrics.

* * * * *